US011608607B2

(12) United States Patent
Rupp

(10) Patent No.: US 11,608,607 B2
(45) Date of Patent: Mar. 21, 2023

(54) CONTROL APPARATUS FOR SOIL COMPACTING APPARATUS

(71) Applicant: Wacker Neuson Produktion GmbH & Co. KG, Reichertshofen (DE)

(72) Inventor: Ferdinand Rupp, Munich (DE)

(73) Assignee: Wacker Neusen Produktion GmbH & Co. KG, Reichertshofen (DE)

( * ) Notice: Subject to any disclaimer, the term of this patent is extended or adjusted under 35 U.S.C. 154(b) by 198 days.

(21) Appl. No.: 16/837,161

(22) Filed: Apr. 1, 2020

(65) Prior Publication Data

US 2020/0318308 A1 Oct. 8, 2020

(30) Foreign Application Priority Data

Apr. 5, 2019 (DE) ..... 10 2019 109 021

(51) Int. Cl.
*E01C 19/40* (2006.01)
*E02D 3/074* (2006.01)

(52) U.S. Cl.
CPC ..... *E02D 3/074* (2013.01); *E01C 19/402* (2013.01); *E01C 2301/00* (2013.01)

(58) Field of Classification Search
CPC .... E02D 3/074; E01C 19/402; E01C 2301/00
USPC ..... 404/84.05–85, 112–117, 133.05, 133.1
See application file for complete search history.

(56) References Cited

U.S. PATENT DOCUMENTS 4,573,543 A 3/1986 Bataille
7,121,762 B2 * 10/2006 Quenzi ..... E01C 19/006 404/84.1
7,753,621 B2 * 7/2010 Steffen ..... E01C 19/38 404/133.1
7,980,783 B2 * 7/2011 Jaszkowiak ..... E04F 21/248 404/112
8,602,680 B2 * 12/2013 Fischer ..... E01C 19/38 404/133.1

(Continued)

FOREIGN PATENT DOCUMENTS

| | | |
|---|---|---|
| DE | 4016822 | 11/1991 |
| DE | 4129915 | 10/1992 |
| FR | 1274854 | 10/1961 |

*Primary Examiner* — Raymond W Addie

(74) *Attorney, Agent, or Firm* — Boyle Fredrickson S.C.

(57) ABSTRACT

A control apparatus for a soil compacting apparatus such as a vibratory plate has a movable operating element for specifying a running direction of the soil compacting apparatus by way of an operator, and having a hydraulic master device, with a master cylinder, in which a master piston can be moved to and fro in a linear manner, in order to generate a hydraulic signal. A hydraulic connector serves for coupling hydraulic components of the soil compacting apparatus and for transmitting the hydraulic signal from the master device. A transmission device is provided for converting the movement of the operating element into a linear movement of the master piston, it being possible for the operating element to be moved between a first position (V) and a second position (R). The first position corresponds to a maximum forward movement of the soil compacting apparatus, and the second position corresponds to a maximum reverse movement of the soil compacting apparatus. A latching device is provided for releasably holding the operating element in a predefined position, for example the first position.

14 Claims, 4 Drawing Sheets

(56) References Cited

U.S. PATENT DOCUMENTS

2002/0150426 A1* 10/2002 Vandewinckel ..... E04F 21/248
404/112

* cited by examiner

CONTROL APPARATUS FOR SOIL COMPACTING APPARATUS

BACKGROUND OF THE INVENTION

1. Field of the Invention

The invention relates to a control apparatus for a soil compacting apparatus.

2. Discussion of the Related Art

Hand-guided reversible vibratory plates (vibrating plates) are known as a soil compacting apparatus of this type. Vibratory plates of this type have a soil contact plate, on which an unbalance exciter is mounted which, for example, has two eccentric shafts which can be rotated in opposite directions and can be set in opposed rotation by a drive. By way of the rotation of the eccentric shafts in the unbalance exciter, vibrations are generated which can be utilized for soil compacting in a known way.

A longitudinally extending drawbar is provided on the vibratory plate, at the end of which drawbar (drawbar head) a switchover handle is provided, via which an operator not only can steer and guide the vibratory plate, but rather also can set the running direction of the vibratory plate. Unbalance exciters are known to this end, in the case of which the relative phase position of the active eccentric shafts with respect to one another can be changed, in order to change the direction of action of the resulting vibration vectors. Depending on whether a resulting vibration vector is directed in the forward moving direction or in the reverse moving direction, the running direction of the vibratory plate can be defined.

The switchover handle which belongs to a control apparatus for the vibratory plate is as a rule of very stable configuration and makes it possible for the operator firstly to guide and to steer the vibratory plate. Secondly, the switchover handle is configured as a large hand lever and can be pivoted relative to the drawbar head, to which it is fastened. By way of the pivoting of the switchover handle relative to the drawbar head, a hydraulic signal is generated which can be transmitted to the unbalance exciter in the vibratory plate, in order, in a known way, to define or to change the phase position of the eccentric shafts which rotate counter to one another. Therefore, the running direction (forward, reverse) of the vibratory plate can be set with the aid of the switchover handle.

FIG. 1 shows one example of a known control apparatus of this type for a vibratory plate.

A drawbar head with a control housing 1 is configured at the end of a drawbar (not shown), to which drawbar head a switchover handle 2 which serves as an operating element is attached pivotably. The switchover handle 2 can be pivoted about an axle 3 relative to the control housing 1.

A master piston 4 is arranged in the interior of the control housing 1, which master piston 4 can be moved axially to and fro in a master cylinder 5 which is configured in the interior of the control housing 1.

A piston rod 6 which carries a rack 7 is configured as part of the master piston 4 or as an axial extension thereof. The rack 7 meshes with a pinion 8 which is fastened on the axle 3.

Accordingly, pivoting of the switchover handle 2 brings about a rotation of the pinion 8 and therefore a linear displacement of the rack 7, the piston rod 6 and the master piston 4.

A cylinder chamber 9 which can be filled with a hydraulic fluid is provided in front of the master piston 4 on the end side. The cylinder chamber 9 is connected via a hydraulic connector 10 and a hydraulic line (not shown) to a corresponding slave cylinder or slave piston in an unbalance exciter (likewise not shown) of the vibratory plate. By way of the hydraulic coupling of the cylinder chamber 9 to the unbalance exciter, an adjustment or displacement of the master piston 4 therefore brings about a corresponding rotation of the eccentric shafts or unbalance masses in the unbalance exciter (not shown). As a result, the phase position of the eccentric shafts which rotate in opposite directions can be adjusted.

Therefore, the resulting force vector of the unbalance exciter and therefore the running direction of the vibratory plate can be set with the aid of the switchover handle 2.

FIG. 2 shows the control apparatus from FIG. 1 in a perspective view.

It can be seen in the case of the state which is shown in FIG. 1 that the master piston 4 is situated in its frontmost position, and accordingly the cylinder chamber 9 only has a very small volume. In said state, the cylinder chamber 9 is similar to a thin cylindrical disk.

A spring 11 is provided for assisting said position to be reached, which spring 11 presses the master piston 4 into the position which is shown in FIG. 1 or assists a movement in said direction, in order to press out the hydraulic fluid which is situated in the cylinder chamber 9 via the hydraulic connector 10. On account of their inertia, the eccentric shafts or unbalance masses which rotate in the unbalance exciter bring about a self-aligning torque which acts on the hydraulic device in the unbalance exciter and has to be withstood by the master piston 4. In other words, the self-aligning torque brings about a force on the master piston 4, which force presses said master piston 4 out of the maximum position which is shown in FIG. 1. Said force has to be withstood by the master piston 4, in order to maintain the maximum forward movement. In order that the withstanding force does not have to be applied to the master piston 4 exclusively by the operator via the operating lever 2, the spring 11 acts in an assisting manner.

The position which is shown in FIG. 1 therefore corresponds to a maximum forward movement of the vibratory plate. The switchover handle 2 is situated in its frontmost position (arrow direction F in FIG. 1).

In order to achieve a maximum reverse movement of the vibratory plate, the switchover handle 2 can be pivoted rearward, in the arrow direction R, by a defined angle, for example 40 degrees. The pinion 8 is thereupon rotated and likewise pulls the piston rod 6 and the master piston 4 back in the arrow direction R via the rack 7. As a result, the volume in the cylinder chamber 9 is increased, and hydraulic fluid is led in via the hydraulic connector 10. Accordingly, the eccentric shafts in the eccentric exciter which are connected via the communicating hydraulics can rotate with regard to their rotational position and phase position, with the result that finally a maximum reverse movement of the vibratory plate can be achieved.

If the switchover handle 2 is in the middle, that is to say between the maximum forward movement and the maximum reverse movement, what is known as vibration at a standstill is set, in which the vibratory plate vibrates on the spot, in order to bring about local compacting. Any desired intermediate positions are possible in an infinitely variable manner between the extreme positions of the switchover handle 2.

In order to keep the operating forces as low as possible during the switchover of the running direction, the spring 11 which has already been described above is provided which assists the movement of the master piston 4 counter to the hydraulic pressure which prevails owing to the principles involved in the cylinder chamber 9. The spring force of the spring 11 can be designed in such a way that vibration at a standstill is set automatically in the case of the switchover handle 2 being released, that is to say the vibratory plate changes its advancing movement to a standstill automatically.

The described control apparatus has proven itself greatly in practice and is suitable, in particular, even for inexperienced operators, since the machine always moves in that direction, in which the operator holds the switchover handle.

In order to allow the machine to run in a full forward movement, it is required here to press the switchover handle 2 permanently toward the front in the arrow direction F in an active manner. It is therefore not possible for the operator to release the switchover handle 2 and to guide the machine laterally on the protective frame in the case of a full forward movement and, for example, to press against a step, such as a curb, along which it is to be guided directly. Two people are as a rule required for this work, namely the operator of the vibratory plate who holds the switchover handle toward the front, and a second person who guides the vibratory plate laterally and presses it to the side.

SUMMARY OF THE INVENTION

The invention is therefore based on the object of specifying a control apparatus for a soil compacting apparatus, by way of which control apparatus the soil compacting apparatus, in particular a vibratory plate, can be operated with a full forward movement, to be precise even when the operator has released a corresponding operating element. It is to be possible here for the operator to actuate the operating element which is provided for him/her again at any time, in order to control the machine and, in particular, to stop it, or to move it in the reverse direction.

According to the invention, the object is achieved by way of a control apparatus having a movable operating element for specifying a running direction of the soil compacting apparatus by way of an operator. A hydraulic master device includes a master cylinder in which a master piston can be moved to and fro in a linear manner, in order to generate a hydraulic signal; having a hydraulic connector for coupling hydraulic components of the soil compacting apparatus and for transmitting the hydraulic signal from the master device. A transmission device is provided for converting the movement of the operating element into a linear movement of the master piston. The operating element is movable between a first position and a second position, the first position corresponding to a maximum forward movement of the soil compacting apparatus, and the second position corresponding to a maximum reverse movement of the soil compacting apparatus. A latching device is provided for releasably holding the operating element in a predefined position. The predefined position can be the first position, that is to say the position for maximum forward movement. It can also be another defined position, however, for example a position which lies between the first position and the second position, that is to say the two extreme positions.

The operating element can be configured, for example, as a switchover handle, such as a handlebar, a hand lever, a sliding element or a guide lever. In this respect, the term of a switchover handle is to be understood broadly. Here, the operating element can be movable relative to a holder (for example, a drawbar head), in order to reach the two desired positions of the operating element. Here, the operating element can perform a linear movement or, in particular, a pivoting movement.

The movement of the operating element is transmitted to the master piston with the aid of the transmission device. The master piston therefore performs a movement in accordance with the movement of the operating element.

The master piston, as part of the hydraulic master device, generates the hydraulic signal in interaction with the hydraulics and/or a hydraulic fluid, which hydraulic signal can be transmitted via the hydraulic connector and possibly further components (hydraulic line) to further hydraulic components of the soil compacting apparatus. This is, in particular, a hydraulically adjustable unbalance exciter which can be adjusted in this way with the aid of the operating element.

In this definition, the control apparatus can be separated from the actual soil compacting apparatus, for example a vibratory plate, and has corresponding mechanical (for example, fastening via a drawbar head to a drawbar of the vibratory plate) and hydraulic coupling possibilities (hydraulic connector).

The latching device is capable of holding the operating element in the predefined position. The predefined position can be selected in a suitable way, in order, for example, to bring about a forward movement at a defined speed. Thus, for example, a forward movement with a low speed, below the maximum forward movement, can also be achieved.

In the case of one variant of the latching device, it is also possible to vary the predefined position, in order for it to be possible for the operating element to be held and therefore fixed in different positions. The operator thus has the possibility, by way of setting of the latching device, to specify in each case one defined speed which is suitable for the current use in the form of a position of the operating element, and to also hold the operating element in said position.

The predefined position can be the first position, that is to say the position for the maximum forward movement. The latching device is then capable of holding the operating element in the first position. As a result, a maximum forward movement can be maintained even when the operator is no longer holding the operating element in said position, but rather releases it.

Here, the operating element can be held releasably by way of the latching device in such a way that the operating element can be moved out of the predefined position by the operator with the aid of his/her manual force by way of the latching device being overcome.

Here, the operating element is therefore to be held only "releasably" in the predefined, for example first position, in order that it can also be easily moved into another position again by way of the action of the operator on the operating element. The operator has to have the possibility at all times to move the operating element out of the predefined and/or first position by way of actuation of said operating element, that is to say to release it, in order, for example, to stop the maximum forward movement. The releasability of the operating element from the predefined and/or first position therefore means that the operator can release the holding state by way of his/her normal manual force. It goes without saying here that the operator does not first of all have to destroy any connecting means (cutting through a holding wire, etc.).

This possibility is given to the operator with the aid of the latching device.

Here, it is possible for the latching device to be switched into two operating states, namely into a first operating state, in which the releasable holding of the operating element in the predefined and/or first position is brought about by way of the latching device, and into a second operating state, in which the latching device is without action. Therefore, the latching device can be activated or deactivated as required. If the latching device is activated, it can meet the desired function of the releasable holding of the operating element in the first position.

If, in contrast, the latching device is deactivated, it remains without action and does not hold the operating element even when it is in the first position.

This can ensure that the holding of the operating element in the first position, that is to say in the position for maximum forward movement, is brought about only when the operator also desires this by way of activation of the latching device. During normal operation, the function of the latching device can be deactivated.

It is possible for the operating element to be moved in such a way that it can be pivoted about an axle, it being possible for the transmission device to be configured for converting the pivoting movement of the operating element into a linear movement of the master piston. In the case of said variant, it is taken into consideration that the operating element can be, in particular, a pivotable switchover handle, the movement of which is then converted in a suitable way into the linear movement of the master piston.

A control housing can be provided, on which the operating element is held movably, it being possible for the master cylinder and the master piston to be arranged in the control housing. The control housing can be configured, in particular, in the drawbar head which for its part is fastened to the end of a drawbar which is part of the soil compacting apparatus.

The transmission device can have a pinion shaft which is coupled to the operating element, and a rack which is coupled to the master piston, the pinion shaft meshing with the rack in such a way that a rotation of the pinion shaft brings about a linear displacement of the rack.

Here, the rack can be coupled to a piston rod which forms a part of the master piston, or can be configured in the piston rod as part of the master piston. The displacement of the rack therefore also brings about a displacement of the master piston.

The latching device can have a pressure piece with a latching element which is mounted in a sprung manner, it being possible for the latching device to have, furthermore, a recess, into which the latching element can be introduced, and it being possible for the recess to be configured on the transmission device or on the master piston. The pressure piece can be mounted in the control housing. The latching element can be configured as a latching pin and can be held in the pressure piece such that it can be moved counter to a spring.

The pressure piece can be mounted in the control housing, it being possible for the recess to be configured on the master piston or in the pinion shaft, and the latching element being introduced into the recess when the operating element is in the predefined, that is to say, for example, the first position. It is therefore possible that the latching action can take place, for example, via the master piston or the piston rod. It can also take place, however, via the pinion shaft or via the switchover handle, if corresponding latching elements and a suitable recess are configured there.

The piston rod can therefore be latched in the case of one variant. In the case of another variant, the pinion shaft or the switchover handle can be latched. To this end, the circumferential face of the piston shaft has a suitable latching geometry (recess), for example a spherical cap. A corresponding effect can also be realized on the switchover handle. To this end, it is possible to also fasten the pressure piece so as to lie on the outside, that is to say outside the drawbar head or the control housing.

The master piston can have a piston rod, in or on which the rack is configured, it being possible for the recess to be configured in the piston rod, and it being possible for a further, longitudinally extending recess to be configured as a clearance portion in a longitudinal direction of the piston rod offset with respect to the recess. The clearance portion can be provided, in order to rule out a friction on the latching element or the latching pin in the range between the vibration at a standstill or a slight forward movement as far as a full reverse movement. Therefore, as far as possible no friction of the latching element on the piston rod is to act in the ranges outside the full forward movement, in order to ensure satisfactory mobility of the piston rod and the master piston.

The pressure piece can be mounted in the control housing such that it can be moved between two positions, the first position of the pressure piece being defined in such a way that the latching element of the pressure piece can be introduced into the recess, whereas the second position of the pressure piece can be defined in such a way that the latching element cannot be introduced into the recess. In addition, a switchover device can be provided, for moving and holding the pressure piece in a defined manner into/in the first position or into/in the second position. Here, the first position means that the self-holding forward movement can be switched on, that is to say can be activated. In this case, the latching device can fulfill the provided function. In the second position, in contrast, the latching device is deactivated, that is to say switched off and without action. The activation or deactivation state of the latching device can therefore be realized by way of the two positions of the pressure piece. Here, the pressure piece can be mounted such that it can be displaced, in particular, between the two positions.

The switchover device for changing the positions of the pressure piece can have a pivotable lever with an eccentric geometry, it being possible for the lever to be pivoted into two defined positions in accordance with the two positions of the pressure piece. With the aid of the lever, it is therefore possible to change the position of the pressure piece and to determine the two defined positions (first position and second position), in order to activate or to deactivate the latching device in this way.

It can be possible for the operating element to be pivoted into a third position which is provided between the first position and the second position and corresponds to a standstill of the soil compacting apparatus. In this case, a standstill means a state, in which, although the soil compacting apparatus generates vibrations for soil compacting, it does not generate any propulsion. The soil compacting apparatus therefore does not move from the spot, but rather brings about vibration at a standstill.

The soil compacting apparatus can advantageously be a vibratory plate.

Accordingly, a vibratory plate is also specified which can be equipped with a control apparatus of the above-described type.

BRIEF DESCRIPTION OF THE DRAWINGS

These and further advantages and features of the invention will be described in greater detail in the following text on the basis of examples with the aid of the accompanying figures, in which.

DETAILED DESCRIPTION

Figure 1:
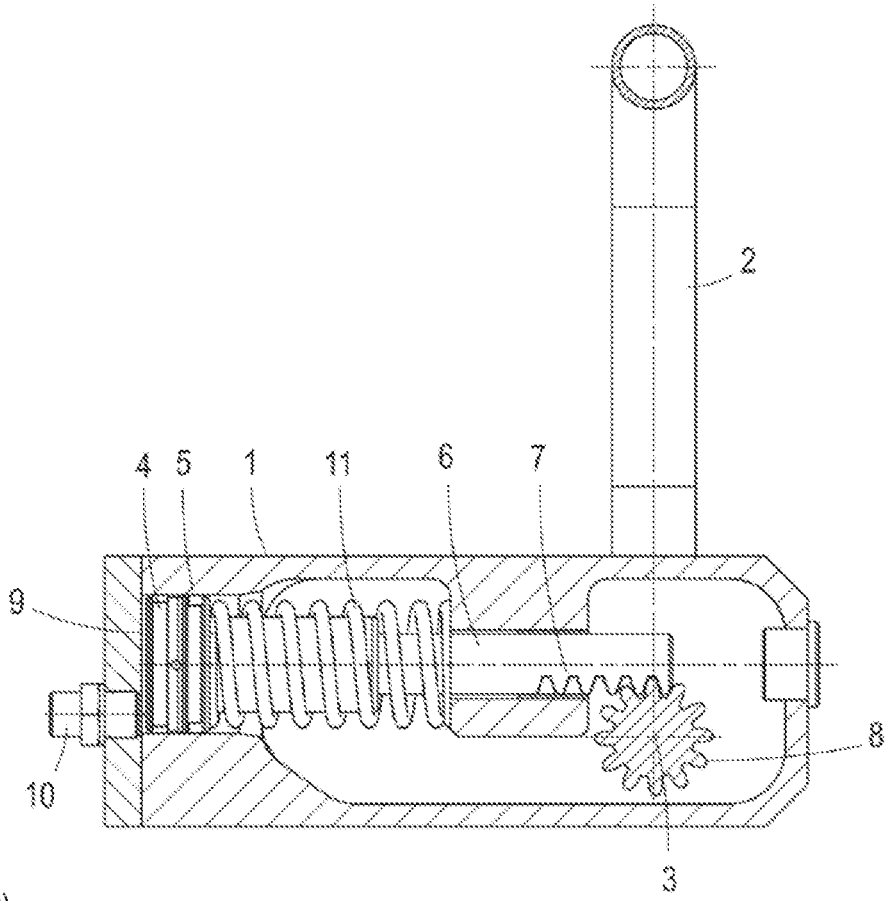
Fig. 1 (Prior Art)
FIG. 1 shows a control apparatus in accordance with the prior art in a sectional illustration and is labeled "PRIOR ART"
Figure 2:
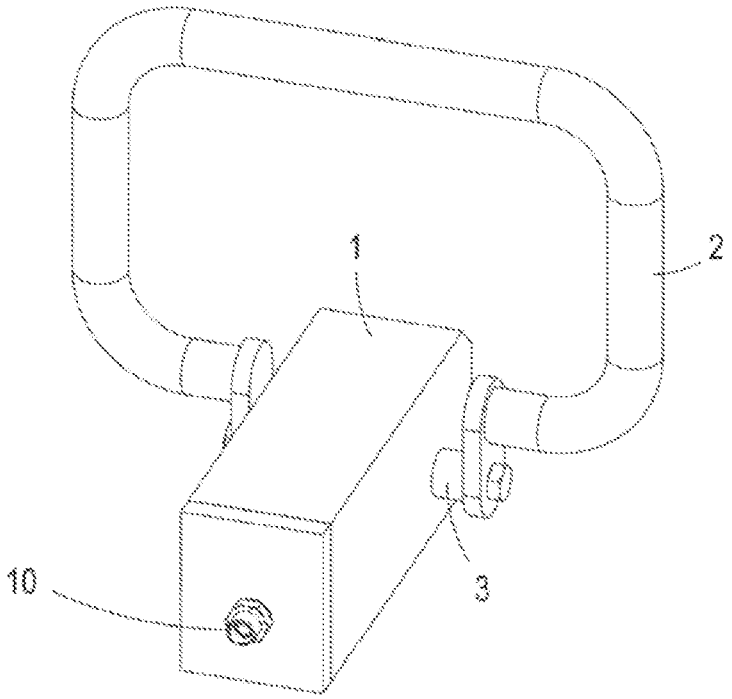
Fig. 2 (Prior Art)
FIG. 2 shows the control apparatus from FIG. 1 in a perspective view and is labeled "PRIOR ART"
Figure 3:
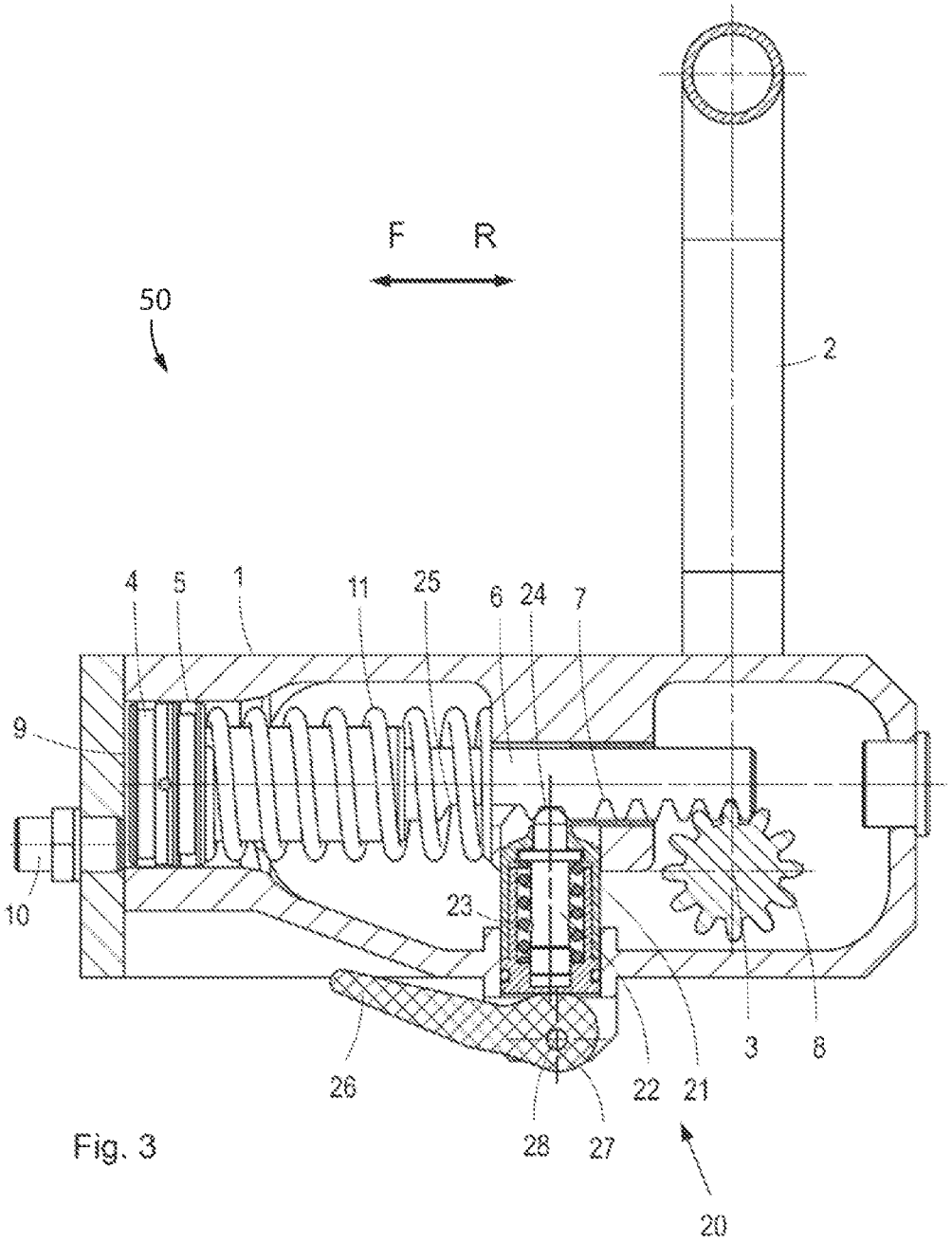
FIG. 3 shows a control apparatus according to the invention with an activated latching device.
Figure 4:
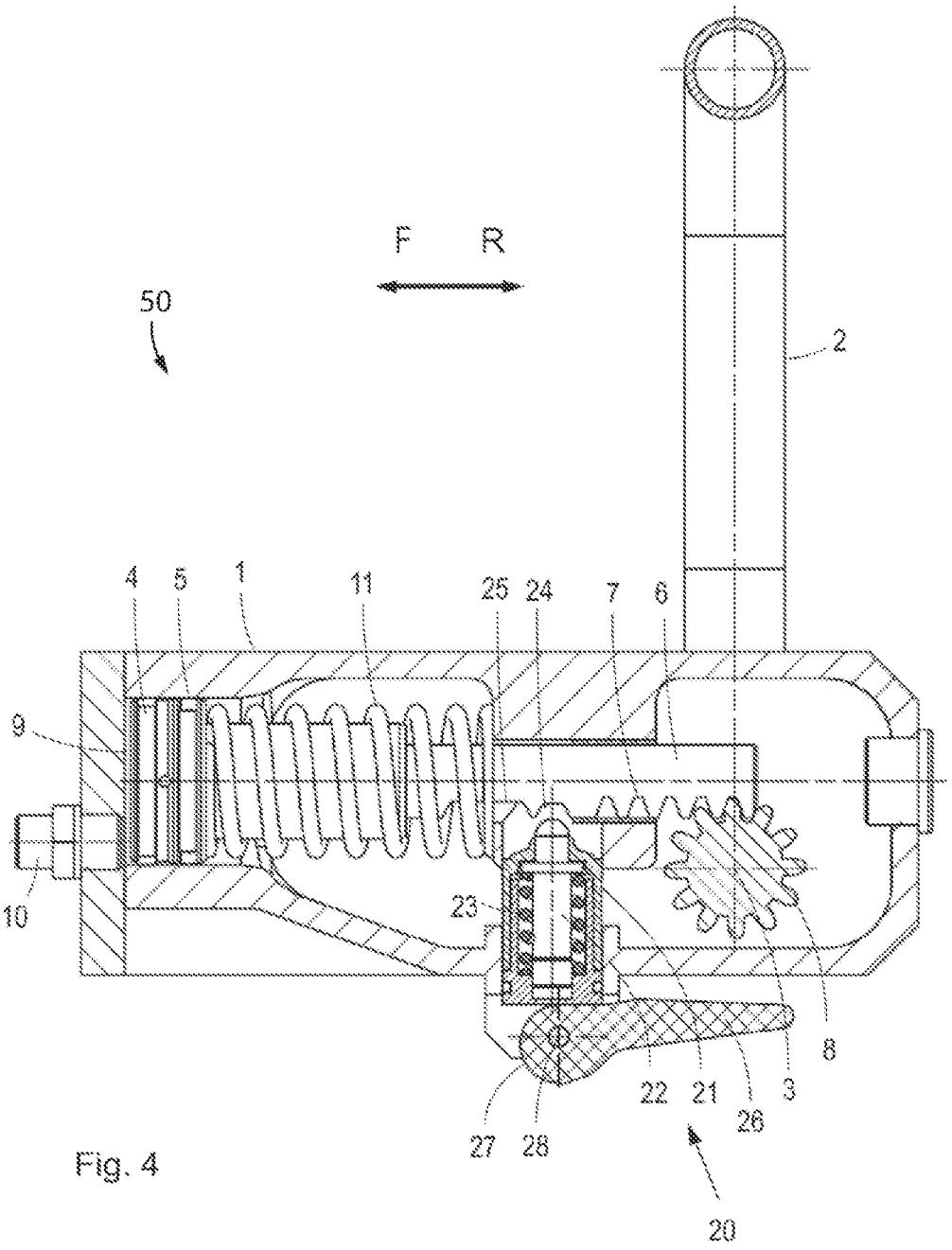
FIG. 4 shows the control apparatus from FIG. 3 with a deactivated latching apparatus, and FIG. 5 schematically shows a vibratory plate machine provided with the control apparatus of FIG. 3.

FIGS. 3 and 4 show a control apparatus 50 which is largely of analogous construction with respect to the control apparatus which is known from the prior art and is described above on the basis of FIGS. 1 and 2. In order to avoid repetitions, identical components are therefore also labeled by way of identical designations. In addition, reference is made to the above description with regard to the general method of operation of the control apparatus.

The control apparatus 50 thus has the switchover handle 2 which can be pivoted relative to the control housing 1. In the case of pivoting of the switchover handle 2, the pinion 8 is rotated about the axle 3, as a result of which the rack 7 which meshes with the pinion 8 is displaced in a linear manner. The rack 7 is configured in one piece together with the piston rod 6 and the master piston 4, with the result that a common displacement of the master piston 4 is brought about. Accordingly, a hydraulic signal can be transmitted via the hydraulic connector 10 to the soil compacting apparatus (not shown), in particular to the unbalance exciter in a vibratory plate.

The switchover handle 2 does not necessarily have to be designed as a hoop-shaped operating element, but rather can also have another suitable design which allows an operation of the machine.

A latching device 20 is provided in addition to the control apparatus 50 which is known in this regard from the prior art. The latching device 20 has a pressure piece 21, in the interior of which a latching pin 22 which serves as a latching element can be displaced counter to the action of a spring 23. The latching pin 22 exits at one end of the pressure piece 21 (the upper end in FIG. 3). Here, the front-side end of the latching pin 22 is of hemispherical or tip-shaped configuration and penetrates into a recess 24 in the piston rod 6. The recess 24 therefore serves as a latching notch, into which the latching pin 22 of the pressure piece 21 can engage.

In the case of a movement of the piston rod 6 in the axial direction, the recess 24 is displaced relative to the tip-shaped end of the latching pin 22, with the result that the latter is pressed into the interior of the pressure piece 21 counter to the action of the spring 23.

FIG. 3 shows a state, in which the switchover handle 2 and therefore the master piston 4 are in a position for maximum forward movement. In this state, the latching pin 22 is at the level of the recess 24, with the result that the tip of the latching pin 22 can penetrate into the recess 24.

Depending on the positioning of the latching pin 22 and the recess 24, it is also possible to latch the switchover handle 2 in another position than in the position shown in FIG. 3 for maximum forward movement. For example, the latching device 20 can be positioned with the recess 24 in such a way that a latching action of the switchover handle 2 takes place in a position which corresponds to a reduced, that is to say retarded, forward movement. In this way, consideration can be given to safety concerns, in order that the vibratory plate cannot move with a maximum forward movement without control by way of the operator, but rather precisely only with a reduced forward movement.

The latching pin 22 of the pressure piece 21 is spring-prestressed, the spring force being sufficiently great to hold the master piston 4 at the front, that is to say in the full forward movement shown in FIG. 3, which master piston 4 experiences a system-related restoring force. Here, the switchover handle can then be released by the operator and nevertheless does not move automatically into the neutral position for the vibration at a standstill.

In the case of switched-on self-holding forward movement (activation of the latching device), the latching pin 22 bears merely against the lefthand flank of the recess 24 and is already pressed slightly into the pressure piece 21 in the process, that is to say the upper side of the collar of the latching pin 22 is free. This ensures that the master piston 4 is always pressed fully and without play toward the front (in the direction F).

In another state (not shown), in which the switchover handle 2 is pivoted, for example into a position for maximum reverse movement, the position of the master piston 4 also changes together with the piston rod 6 and the rack 7. Accordingly, the recess 24 is displaced relative to the tip of the latching pin 22, with the result that the latching pin 22 is not seated in the recess 24. As a result, the master piston 4 can be moved freely in the linear direction. No latching action of the master piston 4 or the switchover handle 2 takes place.

In order to increase the free mobility further in this state, a clearance portion 25 is configured in the piston rod 6 in addition to the recess 24. Here, the tip of the latching pin 22 can penetrate, without achieving a latching action. The clearance portion 25 can also be configured so as to be so deep that the latching pin 22 does not make contact with the piston rod 6 and no frictional effect between the two components is generated either.

The complete pressure piece 21 including the latching pin 22 is mounted in the control housing 1 such that it can be moved in the axial direction. As a comparison of FIGS. 3 and 4 shows, the pressure piece 21 can therefore be moved between two positions and can be locked in the respective positions. In a first position (FIG. 3), it is possible that the tip of the latching pin 22 can penetrate into the recess 24 of the piston rod 6, as described above.

In contrast to this, in the case of the second position which is shown in FIG. 4, the pressure piece 21 is disengaged somewhat downward in the axial direction or is spaced apart somewhat from the piston rod 6. As a result, the length of the latching pin 22 is no longer sufficient, in order to penetrate into the recess 24. In this state, the latching device 20 with the pressure piece 21 and the latching pin 22 is therefore without action and is thus deactivated.

A switchover lever 26 is provided for switching over between the two positions of the pressure piece 21 and therefore for activating and deactivating the latching device 20, which switchover lever 26 has an eccentric outer face 27 and can be pivoted about a rotational axis 28, as is also shown in FIGS. 3 and 4.

In the position which is shown in FIG. 3, the spacing between the eccentric outer face 27 which makes contact with the pressure piece 21 and the rotational axis 28 of the switchover lever 26 is greater than in the case of the position which is shown in FIG. 4. Accordingly, in the case of the position which is shown in FIG. 3, the pressure piece 21 is pressed in the direction of the recess 24.

During normal working operation of the soil compacting apparatus, the operator will as a rule set the maximum forward movement, in order to achieve a rapid work result. To this end, the described latching action of the switchover handle 2 can be helpful because it makes it possible for the operator to release the switchover handle 2 and nevertheless retain the maximum forward movement.

If the operator wishes to stop the machine or move it in a reverse movement, the latching or holding mechanism can be overridden. To this end, the operator pulls the switchover handle 2 back as usual, but with a somewhat elevated force effort. Here, the latching pin 22 is pressed into the pressure piece 21 counter to the spring force, until the restriction of the recess 24 is overcome completely. Subsequently, the latching pin 22 can disengage again. The disengaged latching pin 22 then lies with its collar within the pressure piece 21, and moves in the clearance portion 25, that is to say in a contact-free manner with respect to the piston rod 6. Therefore, no additional friction is generated between the piston rod 6 and the latching pin 22, which allows the vibratory plate to move automatically from reverse movement or possibly from slight forward movement into vibration at a standstill even in the case of a switched-on self-holding forward movement (activated latching device).

If the operator then wishes to move into the maximum forward movement again, he/she presses the switchover handle forward again, as a result of which the latching pin 21 again moves over the boundary of the recess 24 (latching notch). Here, the spring prestress is perceived as a latching action via a change in the operating force on the switchover handle 2.

If a latching action of this type is not desired by the operator, he/she can deactivate the latching device 20 by way of the switchover lever 26 being moved back, and he/she can therefore switch off the self-holding forward movement. If the piston rod 6 is then moved, the flank of the recess 24 pushes the complete pressure piece 21 away from the piston rod 6 without resistance. This operation is not perceived by the operator.

In the case of one variant, the pressure piece 21 can also be provided with an external thread and can be screwed by means of a tool into the control housing 1 or the drawbar head. In this case, a switch-on capability without tools is possible.

In the case of another variant, the pressure piece 21 can be provided with a coarse thread and can be screwed in or out manually via a rotary lever as far as respective end stops, whereby there is a switch-on capability without tools. The thread can be selected in such a way that even half a revolution is sufficient for switching on or off (activation and deactivation of the latching device).

The latching pin 22 which serves as a latching element can also be replaced by a spring-prestressed ball. In this case, the pressure piece 21 can also be realized as a standard ball pressure piece.

The pressure piece 21 and therefore the entire latching device 20 do not have to be arranged from below, as shown in FIG. 3. An arrangement from above or from the side is likewise possible.

Figure 5:
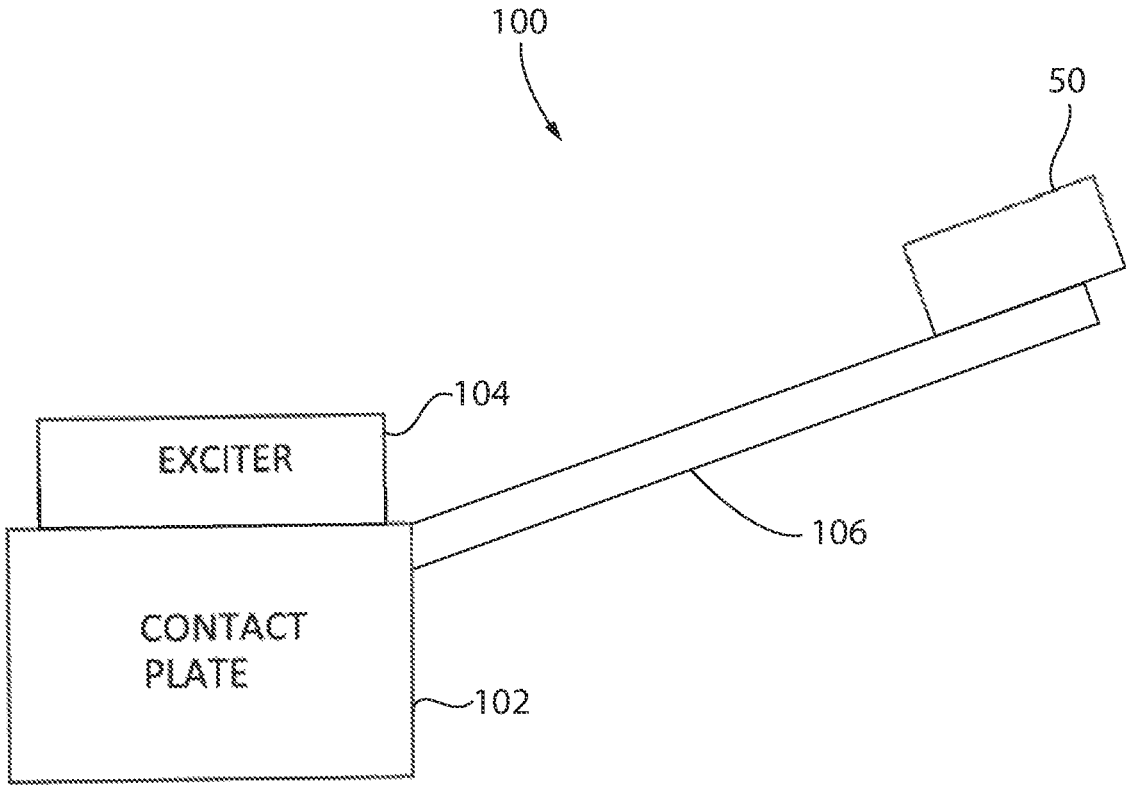

Referring to FIG. 5, a vibratory plate 100 is schematically illustrated as being provided with the control apparatus 50 of FIG. 3. The vibratory plate 100 includes a soil contact plate 102, on which an unbalance exciter 104 is mounted which, for example, has two eccentric shafts which can be rotated in opposite directions and can be set in opposed rotation by a drive. A longitudinally extending drawbar 106 is provided on the soil contact 102. The control apparatus 50, including the switchover handle 2 (FIGS. 3 and 4), is provided at a free end or drawbar head of the drawbar 106.

I claim:

1. A control apparatus for a soil compacting apparatus, comprising:

an operator-controlled movable operating element for specifying a running direction of the soil compacting apparatus;

a hydraulic master device having a master cylinder in which a master piston can be moved to and fro in a linear manner in order to generate a hydraulic signal;

a hydraulic connector for coupling hydraulic components of the soil compacting apparatus to one another and for transmitting the hydraulic signal from the master device; and a transmission device for converting the movement of the operating element into a linear movement of the master piston, wherein the operating element is movable between a first position (V) and a second position (R), the first position corresponding to a maximum forward movement of the soil compacting apparatus, and the second position corresponding to a maximum reverse movement of the soil compacting apparatus, and wherein a latching device is provided for releasably holding the operating element in a predefined position, wherein the latching device has a pressure piece with a latching element which is mounted in a sprung manner, and wherein the latching device has a recess into which the latching element can be introduced, and wherein the recess is configured on the transmission device or on the master piston.

2. The control apparatus as claimed in claim 1, wherein, the predefined position corresponds to the first position.

3. The control apparatus as claimed in claim 1, wherein the operating element is held releasably by way of the latching device in such a way that the operating element can be moved out of the predefined position by the operator with the aid of his/her manual force by way a latching force of the latching device being overcome.

4. The control apparatus as claimed in claim 1, wherein the latching device is switchable between two operating states, namely a first operating state in which the releasable holding of the operating element in the predefined position is brought about by way of the latching device, and a second operating state in which the latching device is without action.

5. The control apparatus as claimed in claim 1, wherein the operating element is pivotable about an axle; and the transmission device is configured for converting the pivoting movement of the operating element into a linear movement of the master piston.

6. The control apparatus as claimed in claim 1, further comprising a control housing in which the operating element is moveably held and in which the master cylinder and the master piston are arranged.

7. The control apparatus as claimed in claim 1, wherein, the transmission device has a pinion shaft which is coupled to the operating element, and a rack which is coupled to the master piston; and wherein the pinion shaft meshes with the rack in such a way that a rotation of the pinion shaft brings about a linear displacement of the rack.

8. The control apparatus as claimed in claim 1, wherein, the pressure piece is mounted in the control housing;

the recess is configured on the master piston or in the pinion shaft; and wherein the latching element is introduced into the recess when the operating element is in the predefined position.

9. The control apparatus as claimed in claim 1, wherein the master piston has a piston rod in which the rack is configured;

the recess is configured in the piston rod; and wherein a further, longitudinally extending recess is configured as a clearance portion in the longitudinal direction of the piston rod offset with respect to the recess.

10. The control apparatus as claimed in claim 1, wherein the pressure piece is mounted in the control housing such that it can be moved between two positions;

the first position of the pressure piece being defined in such a way that the latching element of the pressure piece can be introduced into the recess, and the second position of the pressure piece being defined in such a way that the latching element cannot be introduced into the recess; and further comprising a switchover device for moving and holding the pressure piece in a defined manner into/in the first position or into/in the second position.

11. The control apparatus as claimed in claim 1, wherein the switchover device has a pivotable lever with an eccentric geometry; and wherein the lever is pivotable into two defined positions in accordance with the two positions of the pressure piece.

12. The control apparatus as claimed in claim 1, wherein the operating element is pivotable into a third position which is provided between the first position and the second position and which corresponds to a standstill of the soil compacting apparatus.

13. The control apparatus as claimed in claim 1, wherein, the soil compacting apparatus is a vibratory plate.

14. A vibratory plate comprising:

a soil contact plate, an unbalance exciter mounted on the soil contact plate;

a longitudinally extending drawbar provided on the vibratory plate and having a free end, a control apparatus provided on the free end of the drawbar, the control apparatus including an operator-controlled movable operating element for specifying a running direction of the vibratory plate;

a hydraulic master device having a master cylinder in which a master piston can be moved to and fro in a linear manner in order to generate a hydraulic signal;

a hydraulic connector for coupling hydraulic components of the vibratory plate to one another and for transmitting the hydraulic signal from the master device; and a transmission device for converting the movement of the operating element into a linear movement of the master piston, wherein the operating element is movable between a first position (V) and a second position (R), the first position corresponding to a maximum forward movement of the vibratory plate, and the second position corresponding to a maximum reverse movement of the vibratory plate, and wherein a latching device is provided for releasably holding the operating element in a predefined position, wherein the latching device has a pressure piece with a latching element which is mounted in a sprung manner, and wherein the latching device has a recess into which the latching element can be introduced, and wherein the recess is configured on the transmission device or on the master piston.

* * * * *